US005465462A

United States Patent [19]

Yamada

[11] Patent Number: 5,465,462

[45] Date of Patent: Nov. 14, 1995

[54] SWINGABLE HANDLE ASSEMBLY

[75] Inventor: Kenichi Yamada, Tokyo, Japan

[73] Assignee: Takigen Manufacturing Co. Ltd., Tokyo, Japan

[21] Appl. No.: 191,805

[22] Filed: Feb. 3, 1994

[30] Foreign Application Priority Data

Feb. 18, 1993 [JP] Japan ..... 5-010986 U

[51] Int. Cl.[6] ..... E05C 3/04; E05B 5/02

[52] U.S. Cl. ..... 16/112; 16/115; 292/DIG. 31

[58] Field of Search ..... 16/112, 115, 127, 16/321, 325, 334; 292/DIG. 31, DIG. 73, 336.3

[56] References Cited

U.S. PATENT DOCUMENTS 2,717,796 9/1955 Cudney ..... 292/DIG. 31
4,365,831 12/1982 Bourne ..... 292/DIG. 31
4,548,435 10/1985 Bourne ..... 292/229

*Primary Examiner*—Timothy V. Eley
*Assistant Examiner*—Kenneth J. Hansen
*Attorney, Agent, or Firm*—Martin Smolowitz

[57] ABSTRACT

Swingable handle assembly comprises a push button 3 operated with a minimum of effort; an arm 16 in a rear surface of the button 3 obliquely projects upward and outward therefrom; a handle 2 is in an elongated hole 9 of a casing 1 and vertically adjacent to the button 3 in the hole 9; the handle 2 has it supper-end portion pivoted to the casing 1 through a pivot 17 through which a spring 5 for biasing the handle 2 toward its projecting position is pivoted to the casing 1; the arm 16 has its front-end portion pivoted to the casing 1 through a pivot 8; a return spring 6 is interposed between the button 3 and the casing 1; provided in a side surface of the button 3 is a projection 11 abutting on a rear surface of an edge portion of the hole 9; the handle 2 has a front corner of its lower-end portion formed into a shoulder 12 abutting against an upper-end projecting edge portion 10 of the button 3.

2 Claims, 6 Drawing Sheets

SWINGABLE HANDLE ASSEMBLY

BACKGROUND OF THE INVENTION

1. Field of the Invention

The present invention relates to a swingable handle assembly in which a handle is substantially flush with a surface of a door during non-use of the handle, the handle being projected into its holdable position in use by a user operating a push button of the handle assembly.

2. Description of the Prior Art

In a conventional swingable handle assembly, a handle is held in its retracted position by the use of torque produced by an eccentric load. In use, the handle is pulled out of its retracted position through a depressing operation, so that there is a fear that a user may injure his finger through such depressing operation.

SUMMARY OF THE INVENTION

It is an object of the present invention to provide a swingable handle assembly which may operate with a minimum of effort applied to a push button thereof, and be free from a fear that a user injures his finger through a depressing operation of the push button.

The above object of the present invention is accomplished by providing:

a swingable handle assembly comprising:

an arm provided in a rear surface of a push button so as to project therefrom;

a handle received in an elongated cavity of a casing so as to be vertically adjacent to the push button in the elongated cavity the handle having its upper-end portion pivoted to the casing through a first cross pivot;

a spring for biasing the handle toward its projecting position;

a return spring interposed between the push button and the casing;

the push button having a front-end portion of the arm pivoted to the casing through a second cross pivot;

the push button having its side surface provided with a projection abutting against a rear surface of an edge portion of the elongated cavity of the casing;

the handle having a front corner portion of its lower-end portion formed into a shoulder portion abutting against an upper-end projecting edge portion of the push button.

DESCRIPTION OF THE PREFERRED EMBODIMENTS

Figure 2:
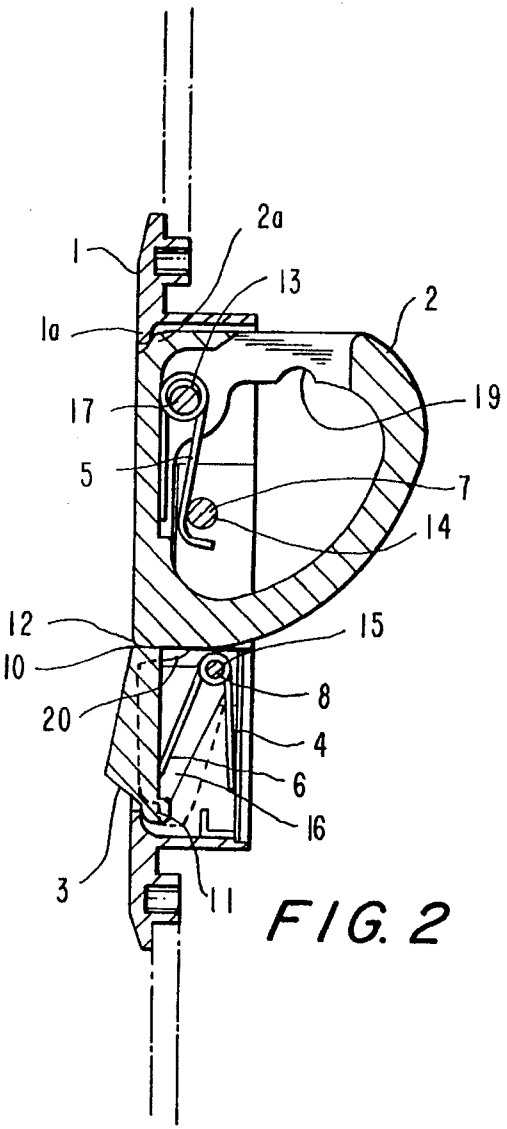
FIG. 2 is a longitudinal sectional view of the swingable handle assembly of the present invention shown in FIG. 1.
Figure 1:
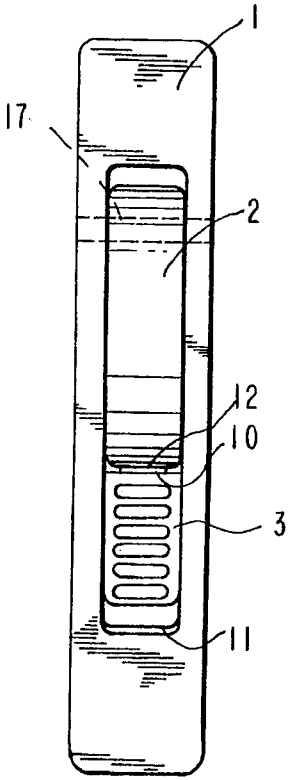
FIG. 1 is a front view of an embodiment of the swingable handle assembly of the present invention.
Figure 4:
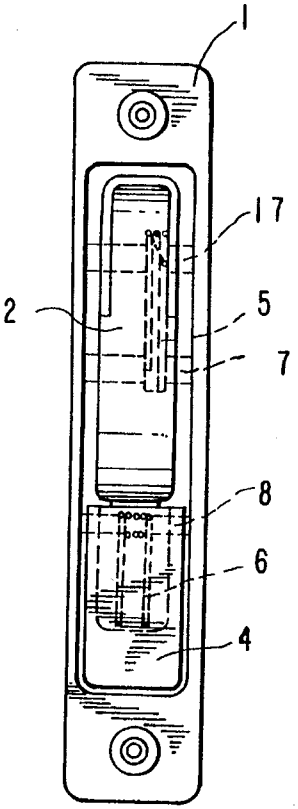
FIG. 4 is a rear view of the swingable handle assembly of the present invention shown in FIG. 1.

Hereinbelow, the present invention will be described in detail with reference to the accompanying drawings and the reference numerals and characters.

In a swingable handle assembly of the present invention, an arm 16 is provided in a rear surface of a push button 3 so as to obliquely project upward and outward therefrom. A handle 2 is received in an elongated cavity 9 of a casing 1 so as to be substantially flush with the casing and vertically adjacent to the push button 3 in the elongated cavity 9 of the casing 1. The handle 2 is generally ring-shaped and has its upper-end portion pivoted to the casing 1 through a first cross pivot 17, inserted in dual holes 13, and through which a spring 5 for biasing the handle 2 toward its projecting position is pivoted to the casing 1. The handle 2 is maintained in a retracted position generally flush with the casing 1 by having an upper notch 2*a* contacting a lip 1*a* of the casing.

The arm 16 of the push button 3 has its front-end portion pivoted to the casing 1 through a second cross pivot 8 inserted through a hole 15 of arm 16 and into dual holes 15*a* in the casing 1. A return spring 6 is mounted on the cross pin 8 and interposed between the push button 3 and a back cover 4 of the casing 1. Provided in a lower side surface of the push button 3 is a projection 11 abutting on a rear surface 18 of an edge portion of the elongated cavity 9 of the casing 1. The ring-shaped handle 2 has a front corner of its lower-end portion formed into a shoulder portion 12 abutting against an upper-end projecting edge portion 10 of the push button 3.

In operation, when the push button 3 is depressed to swing counterclockwise on the second cross pivot 8 against the return spring 6 so as to enter the elongated cavity 9 of the casing 1, since the upper-end projecting edge portion 10 of the push button 3 is separated from the shoulder portion 12 of the handle 2, the handle 2 is rotatably driven clockwise by the spring 5 to swing on the first cross pivot 17 so as to project outwardly from the elongated cavity 9 of the casing 1.

Since there is provided an oblique surface 20 in a lower-end portion of the handle 2, when the handle 2 is pushed into the elongated cavity 9 of the casing 1, the push button 3 is pushed by such oblique surface 20 of the handle 2 to swingably and temporarily move to a lower position indicated in dotted line in FIG. 2. When the handle 2 is completely retracted in the elongated cavity 9 of the casing 1, the push button 3 returns to a position indicated in solid lines so that its upper-end edge portion 10 abuts against the shoulder portion 12 of the handle 2.

At this time, since the projection 11 of the push button 3 abuts against the rear surface 18 of the edge portion of the elongated cavity 9 of the casing 1, the handle 2 is prevented from projecting by the push button 3, so that the handle 2 is held in its retracted position without fail.

Figure 3:
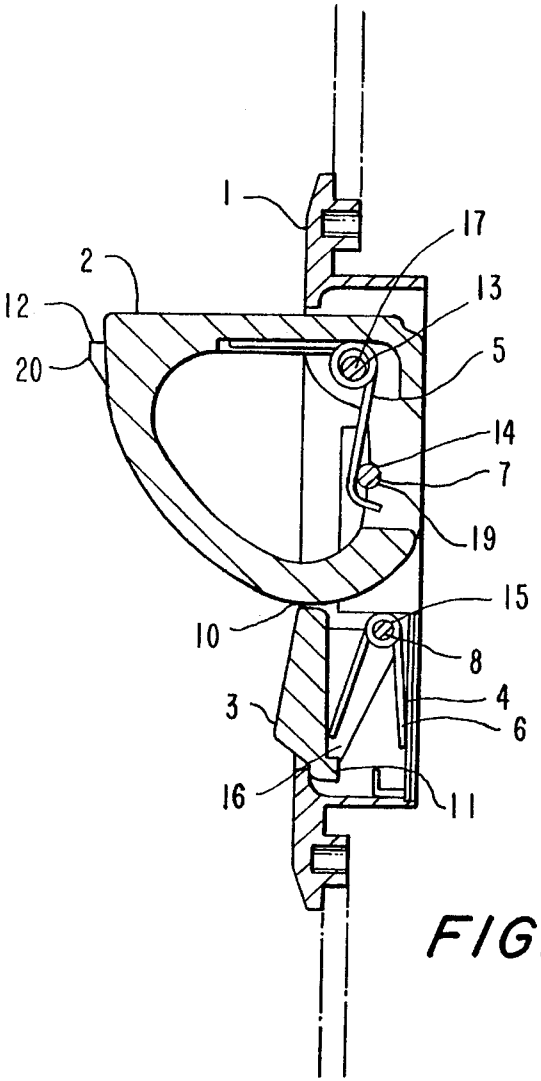
FIG. 3 is a longitudinal sectional view of the swingable handle assembly of the present invention shown in FIG. 1, illustrating the handle is projected in its holdable position.
Figure 5:
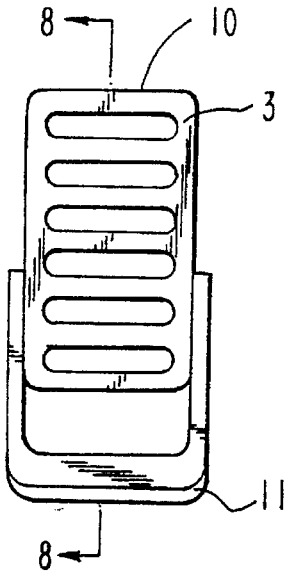
FIG. 5 is a front view of the push button used in the swingable handle assembly of the present invention shown in FIG. 1.
Figure 6:
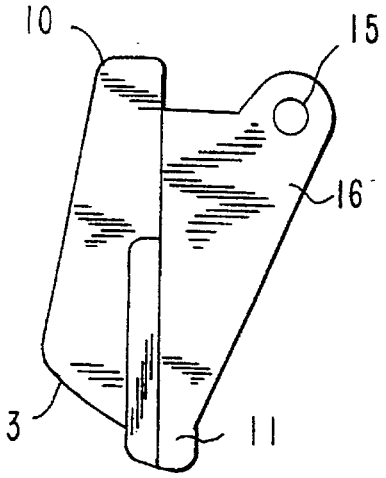
FIG. 6 is a right-side view of the push button shown in FIG. 5.
Figure 7:
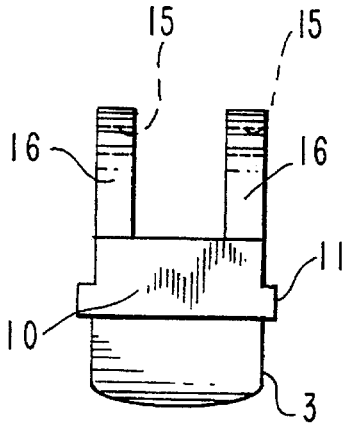
FIG. 7 is a plan view of the push button shown in FIG. 5.
Figure 8:
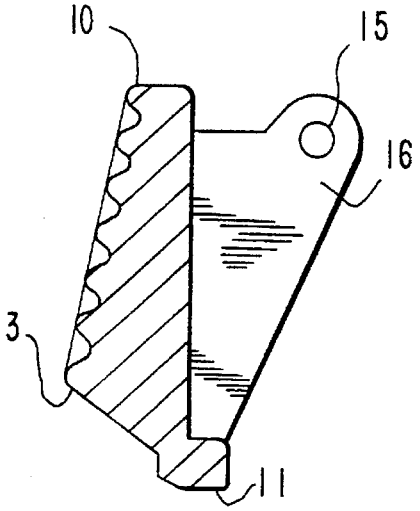
FIG. 8 is a longitudinal sectional view of the push button shown in FIG. 5 taken along line 8—8 of FIG. 5.
Figure 9:
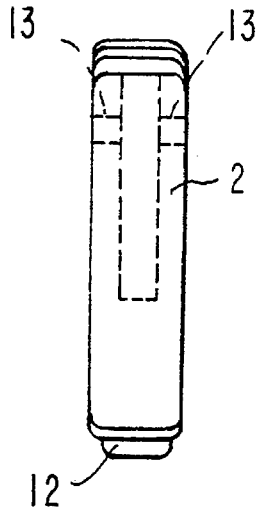
FIG. 9 is a longitudinal sectional view of the handle used in the swingable handle assembly of the present invention shown in FIG. 1.
Figure 10:
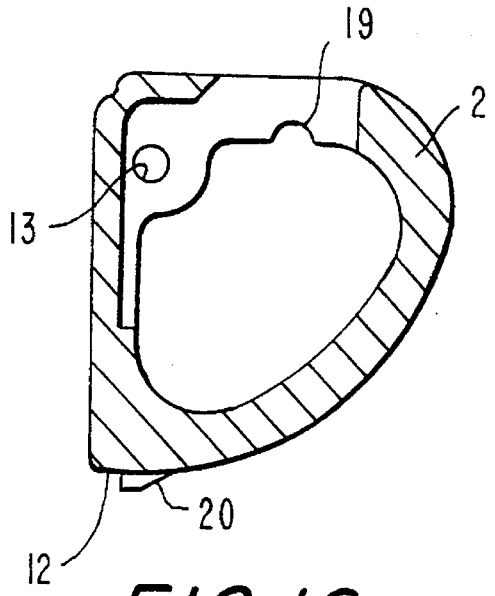
FIG. 10 is a right-side view of the handle shown in FIG. 9.
Figure 11:
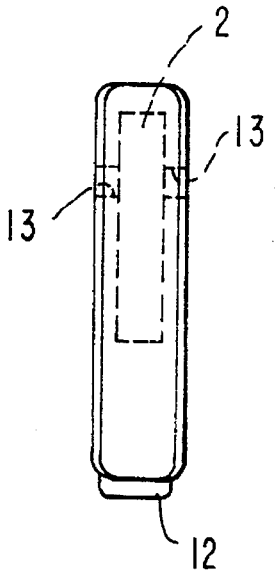
FIG. 11 is a rear view of the handle shown in FIG. 9.
Figure 12:
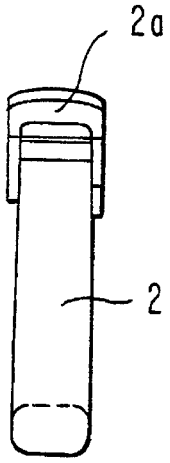
FIG. 12 is a plan view of the handle shown in FIG. 9.
Figure 13:
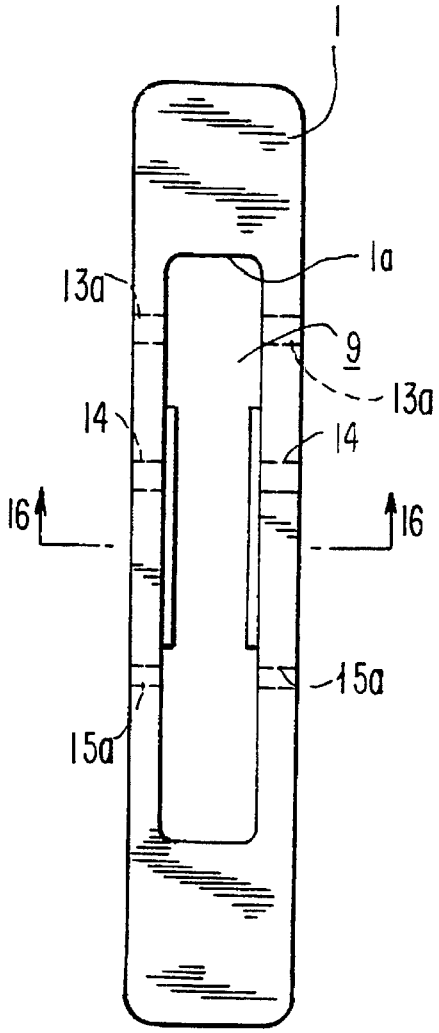
FIG. 13 is a front view of the casing used in the swingable handle assembly of the present invention shown in FIG. 1.
Figure 14:
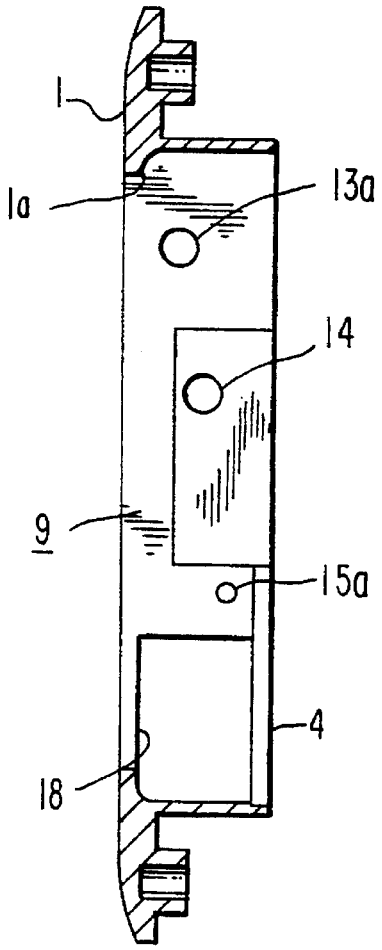
FIG. 14 is a longitudinal sectional view of the casing shown in FIG. 13.
Figure 16:
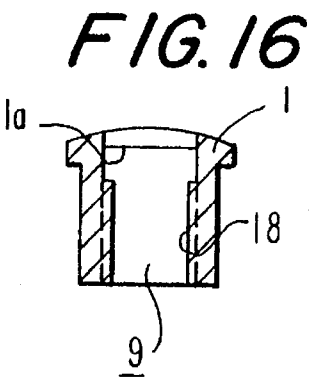
FIG. 16 is a cross-sectional view of the casing, taken along the line A—A of FIG. 13.
Figure 17:
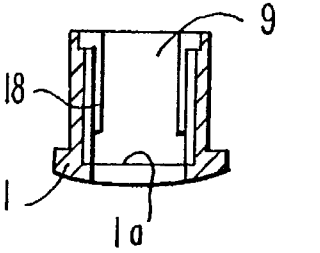
FIG. 17 is a cross-sectional view of the casing, taken along the line B—B of FIG. 15.
Figure 15:
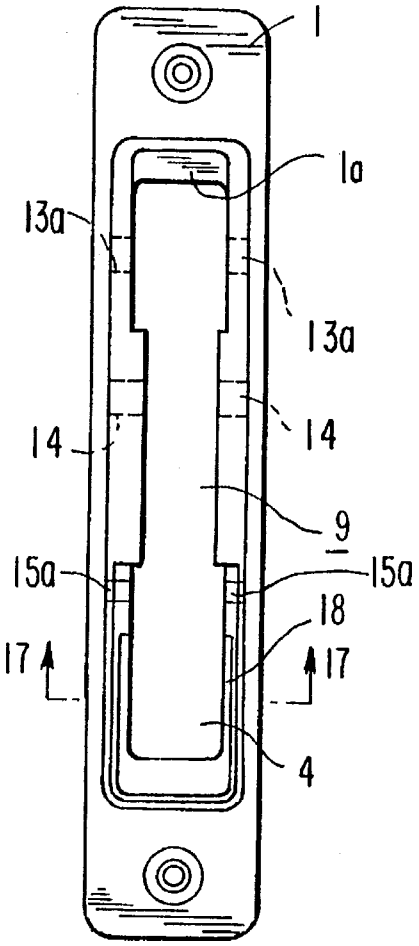
FIG. 15 is a rear view of the casing shown in FIG. 13.

In the embodiment shown in the drawings, the handle 2 is provided with a stopper groove surface 19 which abuts against a third cross pin 7 when the handle 2 is projected (FIG. 3). The third cross pin 7 inserted into dual holes 14 of the casing 1 and engaging with the spring 5 serves as a stopper pin and also serves as a holding pin for an end the spring 5.

The spring 5 for biasing the handle 2 toward its projected position is constructed of a coil spring which has: its coiled portion pivoted to the casing 1 through the first cross pivot 17 firmly inserted in dual holes 13*a*; its one end portion abutted against the rear surface of the handle 2; and, its the other end portion abutted against the cross pin 7 in the casing 1. The return spring 6 for the push button 3 is also constructed of a coil spring which has: its coiled portion pivoted to the casing 1 through the second cross pivot 8; its one end portion abutted against the rear surface of the push button 3; and, its the other end portion abutted against the back cover 4 which is fixedly mounted on the casing 1.

In the swingable handle assembly of the present invention having the above construction, when the push button 3 is depressed, the push button 3 swings in a direction counter to the swinging direction of the handle 2 to have its upper-end projection edge portion 10 separated from the shoulder portion 12 of the handle 2, so that there is substantially no frictional resistance between the upper-end projection edge portion 10 of the push button 3 and the shoulder portion 12 of the handle 2. Consequently, the push button 3 does not require a large pushing force in its depressing operation and may operate with a minimum of effort without fail, which eliminates the fear that the user injures his finger during the depressing operation of the push button 3.

In the swingable handle assembly of the present invention, since the handle 2 is prevented from projecting by the push button 3 and held in its retracted position without fail, there is no fear that the handle 2 is accidentally projected from the casing 1 under the influence of vibrations, impacts and the like, Further, since the first cross pivot 17 through which the handle 2 is pivoted to the casing 1 also serves as the holding pin of the spring 5, it is possible to reduce the number of parts of the handle assembly, which cuts manufacturing costs of the assembly.

What is claimed is:

1. A swingable handle assembly, comprising:

a push button (3) having an arm 16 provided on the push button rear surface so as to project therefrom;

a handle (2) received in an elongated cavity (9) of a casing (1) so as to be vertically adjacent to said push button (3) in said elongated cavity (9), said handle (2) having an upper-end portion pivoted to said casing (1) through a first cross pivot (17) mounted in said casing (1);

a spring (5) pivoted on said first cross pivot (17) for biasing said handle (2) toward an outward projected position for the casing (1), said spring (5) being engaged between said handle (2) and a third cross pin (7) mounted in said casing (1);

a return spring (6) interposed between said push button (3) and said casing (1);

said push button (3) having a front-end portion of said arm (16) pivoted to said casing (1) through a second cross pivot (8) mounted in said casing (1);

said push button (3) also having a side surface provided with a projection (11) abutting against a rear surface (18) of an edge portion of said elongated cavity (9) of said casing (1); and said handle (2) being generally ring-shaped and encircles said first cross pin (17) and said third cross pin (7), said handle (2) having a front corner portion of its lower-end portion formed into a shoulder portion (12) abutting against an upper-end projecting edge portion (10) of said push button (3), and having an inner stopper surface (19) which abuts against said third cross pin (7) of said casing (1).

2. The swingable handle assembly of claim 1, wherein said push button return spring (6) is a coiled type spring pivoted through the second cross pivot (8) to the casing (1), said spring (6) having one end abutted against the push button (3) rear surface and having the spring other end abutted against a back cover (4) of the casing (1).

* * * * *